US010130157B2

(12) United States Patent
Fogueteiro et al.

(10) Patent No.: US 10,130,157 B2
(45) Date of Patent: Nov. 20, 2018

(54) CONTAINER FOR A PASTY OR LIQUID COSMETIC PRODUCT WITH A RETRACTABLE APPLICATION ELEMENT

(71) Applicant: CHANEL PARFUMS BEAUTE, Neuilly-sur-Seine (FR)

(72) Inventors: Paulo Fogueteiro, Nogent sur Oise (FR); Christian Salciarini, Hyeres (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 0 days.

(21) Appl. No.: 15/500,343

(22) PCT Filed: Jul. 31, 2015

(86) PCT No.: PCT/FR2015/052126
§ 371 (c)(1),
(2) Date: Jan. 30, 2017

(87) PCT Pub. No.: WO2016/020610
PCT Pub. Date: Feb. 11, 2016

(65) Prior Publication Data

US 2017/0224089 A1 Aug. 10, 2017

(30) Foreign Application Priority Data

Aug. 4, 2014 (FR) ..... 14 57588

(51) Int. Cl.
*A46B 11/00* (2006.01)
*A45D 40/10* (2006.01)
(Continued)

(52) U.S. Cl.
CPC ..... *A45D 40/10* (2013.01); *A45D 34/046* (2013.01); *A45D 40/264* (2013.01);
(Continued)

(58) Field of Classification Search
CPC ..... A46B 2200/1053; A45D 40/264
(Continued)

(56) References Cited

U.S. PATENT DOCUMENTS 8,287,199 B2 * 10/2012 Salciarini ..... A45D 34/046 401/109
8,287,201 B2 * 10/2012 Salciarini ..... A45D 34/046 401/109

(Continued)

FOREIGN PATENT DOCUMENTS

EP 1 721 543 A1 11/2006
FR 2 936 939 A1 4/2010

(Continued)

*Primary Examiner* — Jennifer C Chiang
(74) *Attorney, Agent, or Firm* — Greenblum & Bernstein, P.L.C.

(57) ABSTRACT

A container for a liquid or pasty cosmetic product has an elongate body, a reservoir that contains the product and is movable in translation in the body between a top working position and a maximum depressed position under the action of an elastically compressible device, and an application element secured to a cap that is retractable into the body and including a shaft that is secured to the cap and is terminated by an applicator suitable for being loaded with product when it is dipped into the reservoir; a peripheral part provided with a locking finger that is movable transversely and a more flexible internal part that are attached to the reservoir close to its edge in order to engage in terms of sealing with a widened portion of the shaft and to lock the latter to the reservoir over only a part of the travel of the reservoir.

10 Claims, 4 Drawing Sheets

(51) Int. Cl.
*A45D 40/26* (2006.01)
*A45D 34/04* (2006.01)

(52) U.S. Cl.
CPC ..... *A45D 40/267* (2013.01); *A45D 2040/105* (2013.01); *A46B 2200/1053* (2013.01)

(58) Field of Classification Search
USPC ..... 401/127, 131
See application file for complete search history.

(56) References Cited

U.S. PATENT DOCUMENTS

| | | | | |
|---|---|---|---|---|
| 8,783,988 | B2 * | 7/2014 | Sanchez ..... | A45D 34/04<br>401/109 |
| 2007/0110502 | A1 | 5/2007 | Salciarini et al. | |
| 2011/0200382 | A1 | 8/2011 | Salciarini et al. | |

FOREIGN PATENT DOCUMENTS

| | | | |
|---|---|---|---|
| FR | 2 982 132 | A1 | 5/2013 |
| WO | WO-2010/043802 | A1 | 4/2010 |
| WO | WO-2016/020609 | A1 | 2/2016 |

* cited by examiner

Fig. 9
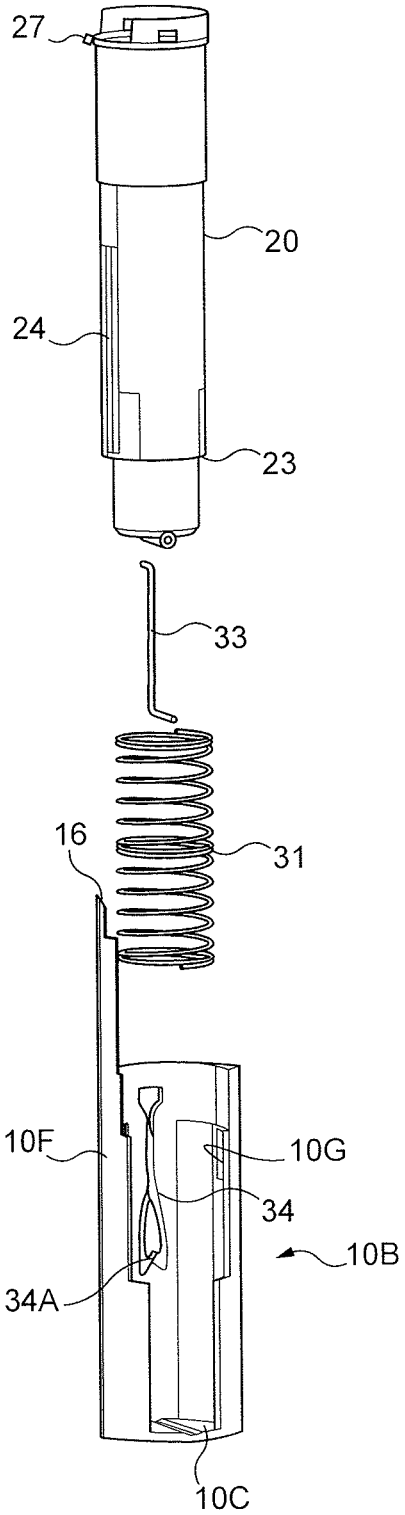
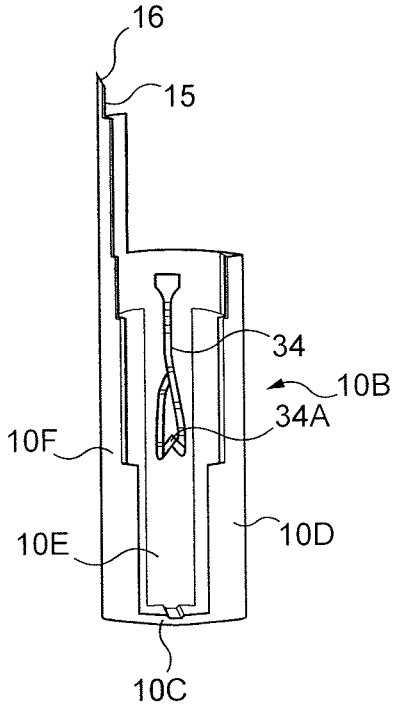
Fig. 10

CONTAINER FOR A PASTY OR LIQUID COSMETIC PRODUCT WITH A RETRACTABLE APPLICATION ELEMENT

BACKGROUND

1. Field of the Invention

The invention concerns a container for a pasty or liquid cosmetic product, comprising a retractable application member, provided with an applicator which, outside of periods when the product is being applied, is engaged in a tubular reservoir containing the product to be applied. It applies particularly well to containers for mascara or gloss, that is to say fluid products, that is to say products that are liquid or viscous.

2. Background Information

Conventionally, containers for liquid or viscous products have an application member. The application member in practice comprises a cap that the user grasps with the fingers of one hand to apply the product to her eyelashes or lips for example. The fact that the product is fluid means that efficient sealing must be provided outside of periods when the product is applied, when the cap is engaged on the neck of the container; in practice this sealing is obtained by a closure by screwing or by clip action of the cap onto the neck of the container. It follows that the cap is a member that forms a substantial part of the outside surface of a mascara or gloss container in a closed configuration, and that combined movements or significant forces may be necessary to open the container before an action to apply product.

A variant has been described in document EP-1 721 543 which, among various containers for cosmetic product, describes a container for mascara (or even for gloss) comprising:

- a body that is elongate in a longitudinal direction and provided with a bottom and a free edge;
- a reservoir contained in that body and movable in translation between a low stable position and a high stable position, the reservoir comprising a neck;
- an elastically compressible device with two stable withdrawal positions that is disposed between the body and the reservoir and of which the two stable axial withdrawal positions define the two stable positions, low and high, of the reservoir;
- an application member comprising a shaft terminated by an applicator adapted to be loaded with mascara, this application member having a resting configuration in which a part of the shaft and the applicator are contained in the reservoir so as to enable the applicator to be loaded with mascara, and being able to leave that resting configuration until it is completely out of the reservoir and of the container;
- a cap joined to the shaft of the application member and adapted to engage within the body, the stable axial withdrawal configurations of the elastically compressible device being such that when the application member is in its resting configuration in the reservoir, the cap is either retracted into the body flush with the free edge of the body, or it projects at least partially from the body;
- a wiper provided at the exit of the reservoir so as to be traversed by the applicator when it enters the reservoir or when it is extracted out of it; and
- complementary sealing members respectively carried by the shaft and the neck of the reservoir constituted by a protuberance carried by the shaft and anchoring claws provided on the neck of the reservoir; in the high position of the reservoir, the claws spread outside the inside volume of the body in which the reservoir slides, whereas in the low position, the claws are maintained in a brought-together configuration by the inside wall of that body so as to remain engaged on the protuberance.

Such a configuration is simple and reliable in use without significant risk of inadvertent opening (the movable part fully retracts telescopically in a resting configuration), while making it possible to have very sleek aesthetics, and without leading to prohibitive voluminosity.

It should be noted that, in such a container, the reservoir is movable between two main positions that are essentially defined by the elastically compressible device, the complementary sealing members remaining engaged on each other so long as the reservoir has not reached its high position and having to come axially out of the body to be able to separate. This means that the travel of the elastically compressible device must be at least equal to the axial dimension of the cap.

Thus, not only is the use of such a container simple and reliable, but such a container furthermore has good sealing characteristics, without however requiring complex movements by the user, but at the cost of a certain complexity of structure and dimensional constraints.

Document FR-2 936 939 (or EP-2 346 370) then provided a container for a liquid or pasty cosmetic product having better sealing without all the same dimensional constraints.

This container has various differences relative to the teachings of document EP-1 721 543.

In particular, as regards the sealing members, the shaft comprises a protuberance comprising, towards the applicator, a sealing portion and, towards the cap, a transverse contact surface, and the reservoir comprises, before reaching its neck, a constriction adapted to receive the sealing portion in axial abutment and, beyond its neck, a collar formed, along its circumference, by a plurality of rigid sectors and elastic sectors, that collar having a relaxed configuration in which it is of larger transverse size than the inside cross section of the body and a restricted configuration in which it is confined inside the body, the rigid sectors comprising, along the inside edge of the collar, rims adapted to come into axial abutment against the transverse contact surface of the protuberance so as to maintain the sealing portion against the constriction when the application member is in its resting configuration. In a particular embodiment, at least the rigid sectors of the collar further comprise outside rims bearing against the inside wall of the body for maintaining the collar in its restricted configuration inside the body. Advantageously, the collar is linked by a skirt also formed by rigid or flexible portions, capping the constriction of the reservoir. In a particular embodiment, the constriction forms part of an added-on part of the reservoir which, towards the inside of the reservoir, comprises a wiper lip.

Furthermore, this document provides that, as soon as the elastically compressible device brings the cap into a configuration in which it gives a sufficient hold for the fingers of a user to be able to pull on it, it is no longer required for that elastically compressible device to be capable of causing the reservoir to rise to attain its high working position, a pulling force on the cap making it possible to complete the rising movement of the reservoir to attain that high position, in which the reservoir can then be held by the presence of a point of increased resistance braking descent from that high position.

It can be understood that the aforementioned cooperation between the protuberance of the shaft and sealing members provided by the neck of the reservoir have, in relation to the teachings of document EP-1 721 543, the advantage of no longer employing claws that are radially movable in relation to the axis of the shaft while being separated by slots liable to become clogged with the product brought by the applicator, which may adversely affect the cleanliness of the neck of the reservoir and the durability of the applicator. As a matter of fact, this document provides to dispose, between the rigid sectors of the collar, elastic sectors that ensure circumferential continuity for the collar.

However, the collar, like the claws of the prior art, can only spread radially and release the protuberance when the reservoir has been sufficiently raised in the body for that collar (or those claws) to be outside the body. In other words, the release of the protuberance is determined by passing the edge of the body into which the application member retracts. Furthermore, the sealing results from the existence of an axial component resulting from the effect of the collar on the protuberance, which amounts to saying that the function of axial linking between the application member and the reservoir and the sealing function are coupled.

SUMMARY

There are however configurations in which it would be advantageous to be able to dissociate the functions of axial linking by locking and sealing, so as in particular to be able to dissociate the aforementioned axial linking at an intermediate level within the body while maintaining the sealing.

To that end, the invention provides a container for a pasty or liquid cosmetic product, comprising:

- an elongate body, extending in a longitudinal direction (Z-Z), provided with a bottom zone and a free edge;
- a reservoir containing the product and that is movable in translation in the body between a position of maximum pushing-in and a position of minimum pushing-in referred to as a high working position, the reservoir comprising a bottom and an edge remote from the bottom;
- an elastically compressible device situated between the body and the reservoir and having two stable axial configurations of withdrawal in relation to a configuration of maximum axial retraction determining the position of maximum pushing-in of the reservoir into the body, that is to say a configuration of maximum extension determining the high working position of the reservoir, and a stable retracted configuration determining for that reservoir a low resting position that is intermediate between the position of maximum pushing-in and the high working position, the passage of the device from one to the other of these stable configurations being made by retraction into the configuration of maximum axial retraction, against an axial spring interposed between that body and that reservoir;
- an application member joined to a cap, and comprising a shaft joined to the cap and terminated by an applicator configured to be loaded with product when it is plunged into the reservoir in a closing configuration in relation to the reservoir in which the shaft traverses the edge of the reservoir, the cap being configured, in the closing configuration, to be retracted at least approximately within the body and, when the reservoir is in its high working position, to project at least partly out from the body by a distance sufficient to enable the extraction of the application member out from the reservoir and from the body by grasping between the fingers of a user and mere axial pulling;
- complementary members distributed on the shaft of the application member and on the reservoir near its free edge to axially link the shaft to the reservoir while ensuring sealing obturation of the reservoir at its edge when the reservoir is in its configuration of maximum pushing-in, wherein the complementary members include at least the following:

- a peripheral part of which an upper portion caps the edge of the reservoir while extending laterally to the inside surface of the body and of which a lower portion is sealingly engaged in the reservoir near its edge;
- an inside part of a more flexible material than that constituting the peripheral part and which is fastened to that peripheral part, the inside part comprising an inside skirt comprising an upper portion having an inside surface which is flared towards the outside of the reservoir;
- a finger that is movable transversely in the peripheral part so as to move closer or farther away from the longitudinal direction, and comprising a head situated transversely outside the reservoir, but always inside the body;
- a cam-forming surface provided on the inside surface of the body, configured to push the head towards the longitudinal direction at the time of a descending movement of the reservoir into the body; and
- a widened portion provided on the shaft at a location such that, when the application member is in its closing configuration in the reservoir, the widened portion is engaged by friction in the upper portion of the inside skirt and, in relation to the longitudinal direction, being at a lower level than that of the finger.

According to the invention, the unlocking of the axial linking between the application member and the reservoir may be made at any location chosen by the designer of the container within the body, without it being necessary for the reservoir, or for the peripheral or inside parts, to leave that body. This contributes to preserving the aesthetics of the container including in configuration of use. Moreover, the engagement by friction of the widened portion of the shaft in the upper portion of the inside skirt, enables satisfactory sealing to be provided independently of the locking in an axial direction provided by the movable finger.

The invention does not involve a number of single parts greater than that provided in the known solutions.

Advantageously, the cam-forming surface is situated so as to cooperate with the head of the finger over the end of the travel of the reservoir towards its position of maximum pushing-in. This amounts to saying that the locking of the application member on the reservoir only occurs over a small part of the range of movement of the reservoir. If the raising of the reservoir to attain its high working position (position of minimum pushing-in) is provided by the elastically compressible device, pulling of the application member by the fingers of a user only occurs in practice at times in which that application member can be separated from the reservoir without it being necessary to preserve the sealing with the reservoir; the engagement by friction of the widened portion in the upper portion of the inside skirt thus does not need to be made with much force.

According to another advantageous feature, the cam-forming surface is situated so as to cooperate with the head of the finger over a longitudinal distance at most equal to one third of the range of movement of the reservoir within the body starting from the low resting configuration.

According to still another advantageous feature, the flared surface of the upper portion of the inside skirt of the inside part is connected to a formation in relief, which is advantageously annular, adapted to cooperate with the widened portion of the shaft, in which is advantageously formed a hollow, which may be annular, adapted to receive that formation in relief. As a variant, the flared surface of that inside skirt is connected to a hollow, which is advantageously annular, adapted to cooperate with the widened portion of the shaft, which is advantageously provided with a formation in relief that is advantageously annular.

According to another advantageous feature, the inside skirt further comprises a lower portion—the inside skirt thus forming a double skirt—and the lower portion converges towards the bottom of the reservoir and towards the longitudinal direction.

The lower portion is for example more flexible than the upper portion.

According to still another advantageous feature, the shaft comprises a constricted zone situated longitudinally at a level such that, when the application member is in its closing configuration in the reservoir, a free edge of the lower portion of the inside skirt of the inside part is situated around that constricted zone. This contributes to enabling a balance of the air pressure within the reservoir and to minimizing the forces to which the lower portion is subjected in the low configuration of the reservoir in the body. To be precise, the deformation of the upper portion on account of the engagement of the widened portion of the shaft may induce an inclination of the lower portion towards the longitudinal direction. There is then no advantage in the lower portion being pressed against the shaft. On the contrary, in a particular embodiment, the lower portion is not elastically acted upon during the periods in which the container is not used.

According to another advantageous feature, the lower portion of the inside skirt of the inside part extends, in the longitudinal direction, over a distance at most equal to half the distance over which extends the upper portion of the inside skirt.

According to another advantageous feature, the lower portion of the inside skirt of the inside part has a thickness that reduces towards the bottom of the reservoir. This makes it possible to confer a large degree of flexibility to the lower portion at its free edge, which facilitates its role as a wiper lip.

According to another advantageous feature, the widened portion of the shaft of the application member comprises a convergent portion extending from an upper edge of a flared surface of the widened portion towards the shaft, for example towards an apex of the shaft, so as to force spreading of the finger in relation to the shaft during a longitudinal movement of taking out the application member from the reservoir. This contributes to ensuring withdrawal of the finger away from the shaft when the head is no longer applied against the cam-forming surface.

According to another advantageous feature, the peripheral part and the inside part are of moldable plastic materials. This enables great simplicity of manufacture.

Furthermore, the peripheral part and the inside part may be formed as a single part or as two separate parts which would then, for example, be fitted elastically together by insertion of one into the other.

According to another advantageous feature, the body comprises an outside part and an inside part in which is provided the cam-forming surface. This enables a material to be chosen for the outside part that provides the desired aesthetics and a different material for the inside part that is compatible with the desired geometry.

According to another advantageous feature, the inside surface of the body and the outside surface of the reservoir comprise complementary members constituting a point of increased resistance inducing resistance to the movements of the reservoir in the body from its high working position, in particular for example the descent of the reservoir into the body from its high working position.

BRIEF DESCRIPTION OF THE DRAWINGS

Aims, features, and advantages of the invention will appear from the following description, given by way of non-limiting illustration, with reference to the accompanying drawings in which:

FIG. 9 shows an exploded view of an inside cage of the body, a spring, a finger and a reservoir of the sub-assembly of FIG. 8; and FIG. 10 presents a perspective view of the cage of FIG. 9.

DETAILED DESCRIPTION

Figure 1:
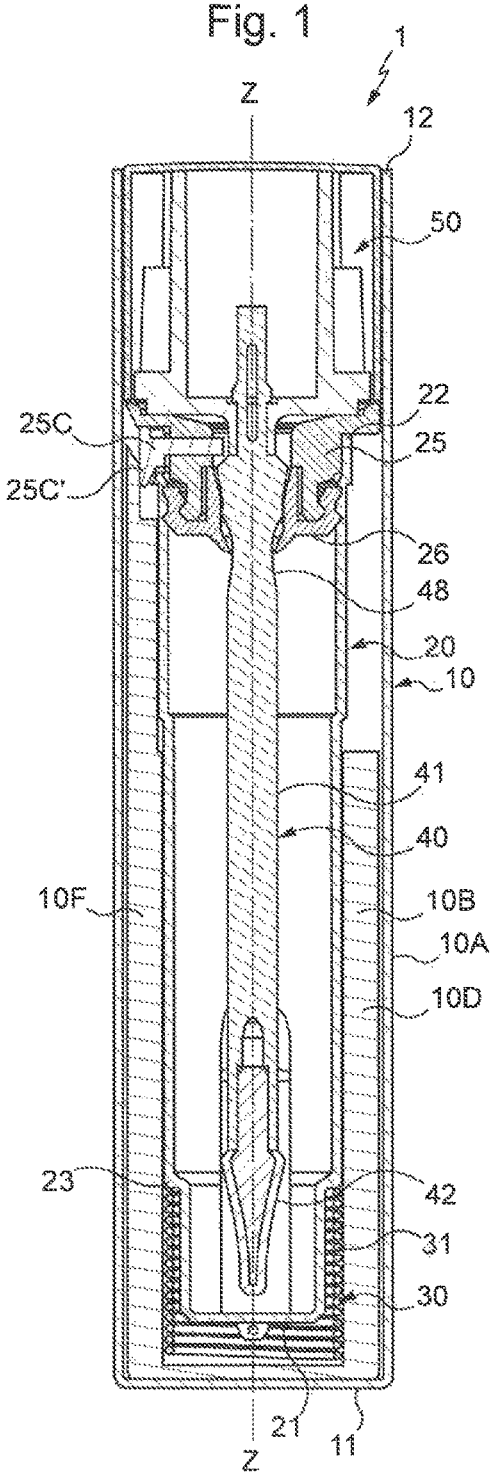
FIG. 1 is an axial cross section view of a container according to a first embodiment of the invention, in a retracted configuration.
Figure 2:
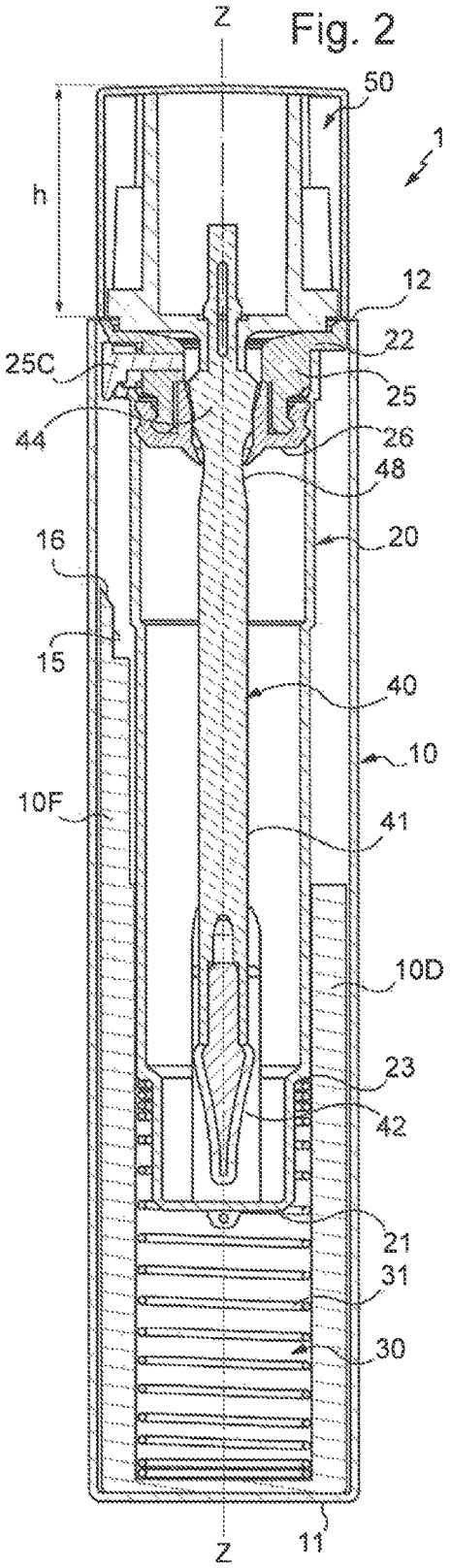
FIG. 2 is a similar view, but in an extension configuration.
Figure 3:
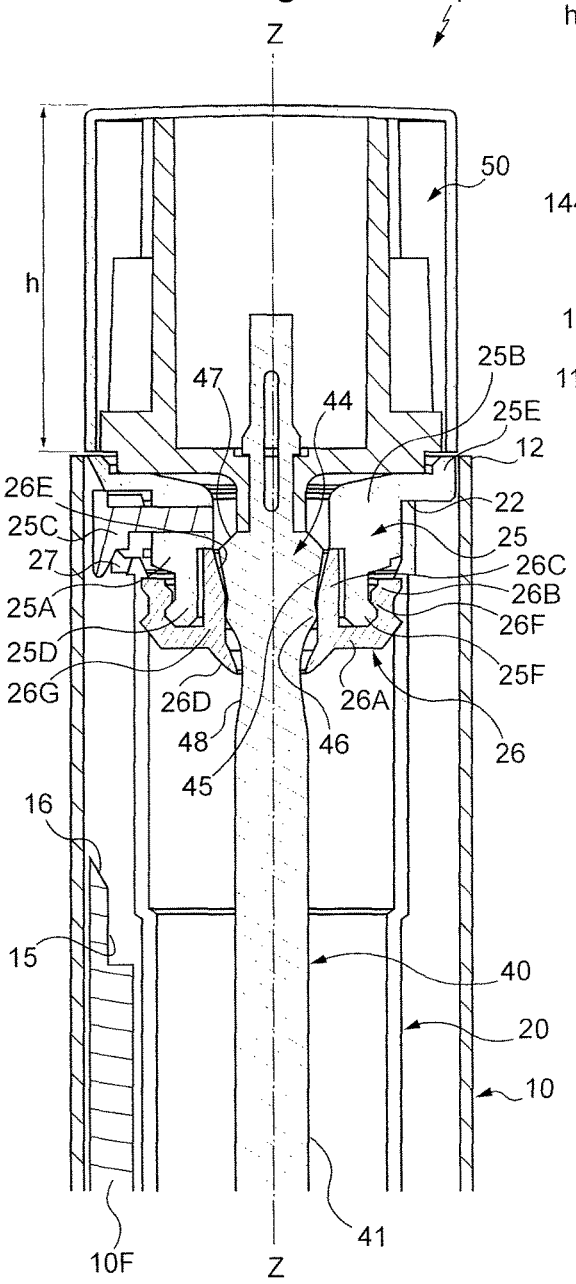
FIG. 3 is an enlarged view of the upper portion of the container in its extension configuration.

FIGS. 1 to 3 represent a container denoted 1 overall. It principally comprises a body 10, a tubular reservoir 20 movable within the body 10, an elastically compressible assembly 30 interposed between the body and the reservoir, an application member 40 configured to cooperate with the reservoir 20 and a cap 50 which bears the application member 40 and which is adapted to obturate the body 10 when the application member 40 is engaged in the reservoir 20.

The body 10 is elongated, extending in a longitudinal direction Z-Z, which is vertical here, provided with a bottom zone 11 and a free edge 12, The longitudinal direction here is an axis of symmetry, the cross section of the body having a square shape (see FIGS. 5 and 6) in the example considered, or more specifically the shape of a rounded square, that is to say that the lateral faces of the body are bowed outwards. As a variant not shown, the cross section may have a rectangular shape, or a simpler geometric shape, for example that of a circle (symmetry of revolution), or even a more complex shape, for example polygonal with a number of corners greater than four, or oval, etc. In a particular embodiment, this longitudinal direction is such that, in any plane passing through it, it is an axis of symmetry for the intersection of the body and that plane.

The body 10 may be formed from one part, or be formed from several parts mounted onto each other (for example a tube to which is mounted a bottom part). In the example represented here, the body is formed by an outside metal sleeve 10A (defining the lateral wall and the bottom), of which the material and the texture are mainly chosen according to the appearance it is desired to give to the container and an inside cage 10B, for example formed from plastic material.

The cage 10B, also represented in FIGS. 9 and 10, here comprises a bottom 10C and three uprights 10D, 10E, 10F which are disposed in three of the four dihedrons of the lateral wall of the sleeve. The outside contour defined by the three uprights of the cage has dimensions substantially equal to the inside dimensions of the sleeve, in order for the cage to be accommodated in the bottom of the sleeve. Moreover, the outside contour defined by the three uprights of the cage has a circular envelope to enable the guiding of a reservoir 20 that is described below. Two of the three uprights have a height that is in the neighborhood of half the height of the sleeve, this height not being critical, and the third upright 10F is extended by a height-increasing portion that ends with an inclined surface 16 and a contact surface for lateral bearing 15. These parts are described below. The assembly has a height that is defined by the height of the sleeve and the range of movement of the reservoir inside the body. This is described in more detail below. The three uprights may be linked together by cross-members distributed over the height of the cage 10B. The opening of the cage, which is located in the dihedron without any upright, enables the part to be demolded at the time of injection molding and also enables the assembly of the reservoir and of the elastically compressible assembly inside the cage.

The cage 10B is accommodated in the bottom of the sleeve 10A and these members are assembled by any appropriate means, in particular by bonding using a thermoplastic adhesive. Other means may also be appropriate. As has already been stated, the sleeve 10A and the cage 10B may form a single part.

The reservoir 20 contains a product that is fluid, which is to say liquid or viscous, to apply using the application member 40. The product is represented by the reference 100 in FIG. 8. Here it is gloss but may, as a variant, be mascara for example. The reservoir 20 comprises a bottom 21 and an edge 22; its cross section is formed so as to be able to slide (simply by movement in translation) between the uprights of the cage between two longitudinally offset configurations of which one corresponds to a maximum pushing-in into the body towards the bottom of the body and the other corresponds to a minimum pushing-in into that body. The reservoir is designed so as to be entirely contained in the body over the entirety of the range of movement between the two pushing-in configurations. The height of the reservoir is thus less than the height of the body reduced by the amplitude of movement of the reservoir between its two pushing-in configurations.

In the illustrated embodiment, the reservoir has a generally circular cross section, as represented in FIG. 9. It is possible for the wall to have a shoulder locally marked by a change in diameter of the reservoir, as for the shoulder 23 which is described below. Internally, the reservoir also has a circular cross section. This cross-sectional shape, however, is not limiting; it is preferred since it enables better output of the product.

The elastically compressible assembly 30 interposed between the cage and the reservoir is designed, in a way known per se, to confer upon the reservoir two stable withdrawal positions in relation to the configuration of maximum pushing-in. In FIG. 1, the reservoir is, in relation to the body, in one of these stable positions, which is qualified as a "stable low position of withdrawal", that is to say in a stable position close to the maximum pushing-in configuration. In FIG. 2, the reservoir is, in relation to the body, in the other stable position of withdrawal, which is a "stable high position of withdrawal" and which corresponds to the minimum pushing-in configuration of the aforementioned reservoir. The assembly 30 in practice comprises a spring 31 compressed longitudinally between the bottom 11 of the body and the reservoir (here between the bottom 10C of the cage and the shoulder 23 formed externally in the wall of the reservoir), combined with a follower finger 33 carried by the reservoir along a track 34, represented in particular in FIG. 9, hollowed out of the upright of the middle of the cage, the upright 10E and of which at least one portion is in the shape of an inverted heart. For more detail, reference may be made in particular to the document EP-1 721 543, or to the document EP-2 346 370. In operation, when the reservoir 20 is in one of its stable positions of withdrawal in relation to the bottom 11 of the body, pressing applied to it until the maximum pushing-in configuration (not shown) is reached enables it, under the effect of the spring 31, to come to its other pushing-in configuration.

Other ways of constructing the elastically compressible assembly may also be suitable, such as those described in the patent application EP 1 721 543 or for instance EP 2 346 370.

The low stable position of withdrawal of the reservoir is defined by the positioning of the follower finger 33 at the "dead center" 34A of the track. The high stable position of withdrawal is defined by the passage of two diametrically opposite skids (only the skid 10G is visible in FIG. 9) that pass in two diametrically opposite grooves hollowed into the outside surface of the reservoir 20 (only groove 24 is visible in FIG. 9). In the high stable position, the skids are in abutment against the lower end of the grooves and the spring 31 is not fully relaxed; it applies a thrust between the cage and the reservoir. Other forms of construction are also suitable for limiting the travel of the reservoir towards the free edge 12 of the body.

The application member 40 comprises a shaft 41 terminating by an applicator 42 configured to be loaded with product when it is plunged into the reservoir in a configuration referred to as a "closing configuration" in relation to the reservoir. At the other end is located the cap 50 by which a user holds the application member when it is used. The applicator 42 is of a known type and is not described in further detail. It may be of the spatula, brush or other appropriate type. It is mounted at the end of the shaft, or else may be formed as a single part with the shaft.

The cap 50 has a cross section shaped so as to be able to slide with a small degree of lateral play in the top portion of the body until it is retracted therein.

The cap 50 is joined to the application member 40, but is generally formed as a part separate from that member. In the example represented, the shaft 41 is surmounted by a head that is mounted with a force fit inside the cap but, as a variant, it may be one and the same part, if the production technique enables this.

The reservoir 20 is provided, on its free edge 22, with a peripheral added-on part 25, in which is mounted an inside added-on part. On account of the respective functions of these two parts, the inside part 26 is of a material having lower rigidity than that of the peripheral part.

As shown in FIG. 3, the peripheral part 25 comprises a lower portion 25A (with reference to the direction Z-Z), of cylindrical general shape and which is engaged by a force fit in the top portion of the reservoir near the free edge 22, and an upper portion 25B that protrudes laterally out of the reservoir to the inside wall of the body, thus obturating the space situated laterally between the outside wall of the reservoir and the inside wall of the body while being able to slide along the inside wall during the movements of the reservoir inside the body. A protruding part 25E of the upper portion 25B, of which the shape and the dimensions substantially correspond to those of the body at the location of its free end 12, may be assimilated to a circumferential lip for sliding able to pass along the inside wall of the body. In this manner, the reservoir is guided in the body, in its bottom portion, by the uprights of the cage and in its top portion by the protruding part 25E that slides along the inside portion of the sleeve.

The upper portion 25B comprises, below the protruding part, a bore directed towards the longitudinal direction Z-Z and in which is mounted a finger 25C configured to slide therein. This bore is perpendicular here to the longitudinal direction Z-Z but may as a variant have a slight inclination in relation to a plane perpendicular to the longitudinal direction Z-Z.

The finger 25C comprises an inside end configured to project, in some of its positions in the bore, towards the longitudinal direction Z-Z, and a widened head 25C' (see FIG. 1) situated outside the upper portion 25B and being configured to cooperate with various surfaces disposed outside the reservoir, as is described below.

For this, the finger may be situated, vertically, above the free edge of the reservoir. However, to ensure optimum mechanical strength properties of the upper portion 25B in the reservoir, and thus optimum holding of the finger in the upper portion, in a particular embodiment, the finger is situated across the wall of the reservoir, by virtue of a longitudinal cut-out (or even a simple opening) formed locally in the wall of the reservoir, which enables that finger to be situated, longitudinally, at a position in which the upper portion 25B is held in the reservoir.

The bottom edge of the cut-out, denoted 27 in FIG. 3 or visible in FIG. 9, is formed so as to be able to serve as an abutment for the head when the finger 25C comes near the longitudinal direction Z-Z.

When the reservoir is in position in the body, the finger 25C is in alignment with the third upright 10F of the cage and its widened head is induced to come into contact with the inclined surface 16 of the upright.

The inclined surface 16 is provided to bring the finger 25C from its position that is away from the longitudinal direction Z-Z (position of FIG. 2) to its position brought near to the longitudinal direction Z-Z (position of FIG. 1) on pushing-in of the cap 50 and the applicator inside the body. The contact surface for lateral bearing 15 retains the finger in its brought-near position when the reservoir is located in its stable low position of withdrawal.

As illustrated in FIG. 3, the inside part 26 here comprises, starting from a transverse portion 26A, an outside skirt 26B and a dual inside skirt 26C+26D. The inside skirt is said to be dual here on account of it comprising an upper portion 26C and a lower portion 26D.

This lower portion is only optional, since the functions of the device of the invention are provided even in the absence of such a lower portion.

The outside skirt 26B is formed so as to have an elastic insertion fit around a bottom portion, 25D, of the lower portion 25A of the peripheral part 25. More specifically, this outside skirt, oriented upwardly in the Figures, here comprises a bead 26F along its top edge, projecting towards the longitudinal direction Z-Z from the outside skirt 26B, while the bottom portion 25D of the peripheral part 25 comprises, along its bottom edge, a bead 25F projecting oppositely to the longitudinal direction Z-Z. It is to be understood that the combination of the two beads 25F and 26F provides a good mutual connection between the parts 25 and 26, although the presence of these beads is merely optional. In a particular embodiment, the transverse part 26A defines the bottom of an annular channel defined by the outside skirt 26B and an upper portion 26C of the dual inside skirt 26C+26D.

The upper portion 26C, oriented upwardly in the Figures from the transverse part 26A, has a wall of which the general orientation is parallel to the longitudinal direction while having an inside surface 26E (facing the longitudinal direction) which is flared upwardly, and an outside surface (facing the bottom portion 25D of the peripheral part 25) which is approximately parallel to the inside surface of this bottom portion of the peripheral part 25. It can thus be said that the upper portion 26C here delimits a volume of substantially cylindrical shape in the mathematical sense of the term (for example of polygonal cross section, or oval, for example), or in the usual sense of the term (cross section of a disk), according to the function of the geometry of the shaft of the application member (see above). An annular space is provided between the upper portion of the dual skirt and the bottom portion of the peripheral part, configured to enable deformation of the upper portion away from the longitudinal direction.

A lower portion 26D of the inside dual skirt, which extends the upper portion 26C downwardly from the transverse part 26A, converges slightly downwardly and towards the longitudinal direction. As described below, this lower portion is configured to perform wiping of the applicator. Furthermore, this lower portion may have a downwardly tapered cross section, giving it flexibility that increases from the transverse portion, enabling it to act as a wiping lip on the shaft. The lower portion of the skirt is however optional.

An intermediate portion 26G links the upper portion 26C and the lower portion 26D. This intermediate portion is cylindrical. The intermediate portion is situated at the location of the transverse part 26A of the inside part.

The outside skirt 26B, which has a function of fastening the inside part 26 to the part 25, and the upper portion 26C of the dual skirt, which, as explained below, has a sealing function, are thicker than the lower portion 26D of the dual skirt that, to be able to properly perform wiping, is more flexible than the other portions.

This form of construction of the peripheral part 25 of the inside part 26 gives good results, but other forms of construction are also possible. In particular, the peripheral part 25 and the inside part 26 could be formed as a single part, by injection molding or according to requirement by bi-injection molding.

The behavior of the finger 25C according to the position of the reservoir in relation to the body enables temporary locking of the application member in the reservoir when the reservoir is in its stable low configuration of withdrawal and the shaft cooperates with the inside part 26 to provide air-tight obturation the reservoir.

As a matter of fact, this finger and the inside part cooperate with a widened portion 44 provided on the shaft 41 of the application member.

In a first phase, when the reservoir descends towards its maximum withdrawal position, the finger comes into contact with the cam-forming surface 16, and is pushed away towards the axis Z-Z, whereas the widened portion 44 is situated below the level of the finger.

Thus, the shaft comprises the widened portion 44 in the vicinity of the cap. The widened portion is configured to cooperate with the inside part 26 when the application member is engaged to the maximum in the reservoir, in the closing configuration, and is thus situated on the shaft in a zone that comes inside the part 26 at the time of this closing configuration.

More particularly, the widened portion 44 has a flared bottom portion 45 that has a geometry and dimensions that are advantageously close to the inside dimensions and geometry of the upper portion of the dual skirt of the inside part 26. In the example represented, the flared inside surface of the upper portion of the dual skirt has an inclination which, in relation to the longitudinal direction, is substantially equal to the inclination of the flared portion 45. As a variant, the inclination of the inside surface may be less by a few degrees than that of the flared portion, to take into account the fact that the dual skirt can tip through a few degrees in relation to the transverse part 26A. These inclinations here result from these surfaces being frusto-conical.

By way of example, the flared surface of the upper portion 26C of the dual skirt and that of the flared portion 45 of the shaft have inclinations equal to at least 3°, for example in a range from 5 to 20°.

In the example represented here, the widened portion 44 further comprises an annular rib 46, in relief, configured to be thrust into the wall of the intermediate portion 26G of the dual skirt 26 by locally deforming that wall. The annular rib 46 is formed here around the flared portion 45. The wall of the intermediate portion can comprise a recessed zone such as a channel configured to receive the annular rib 46 at least partly. As a variant, the flared portion may be connected to a recessed zone configured to cooperate with a zone in relief formed on the wall of the intermediate portion.

By respectively cooperating with the upper portion 26C and the intermediate portion 26G, the flared portion 45 of the shaft and the annular rib 46 produce a sealing closure of the reservoir when the applicator is in the closing position (FIG. 1). In addition to its sealing function, the flared portion 45 also acts on the finger 25C on closing the container if the finger has come towards the axis Z-Z; this is described in more detail below.

The flared portion 45 joins to a top convergent portion 47 of the widened portion 44 which converges towards an upper portion of the shaft.

The convergent portion 47, which is situated below the level of the finger 25C in the closing configuration (FIG. 1), is provided to move the finger away from the axis Z-Z to reach its position of FIG. 2 when the reservoir rises after having left its position of maximum pushing-in.

In the exemplary illustrated embodiment, when the widened portion 44 is engaged in the upper portion 26C of the dual skirt 26, the free end of the lower portion of the dual skirt transversely faces a portion 25C of the shaft that locally has a reduced cross section.

In the closing configuration of FIG. 1, the application member 40 is engaged to the maximum in the reservoir, that is to say that the applicator 42 is in its lowest position in the reservoir. In this closing configuration, the widened portion 44 of the shaft is engaged against the flared inside surface of the upper portion of the dual skirt of part 26, which is able to widen by virtue of the play situated between the outside surface of the upper portion and the inside surface of the bottom portion of the part 25.

The finger 25C, which is located above the level of the widened portion 44, is retained in its position brought near to the axis Z-Z by the contact surface for lateral bearing 15. It retains the applicator by opposing the passage of the widened portion 44. Furthermore, the sealing is provided by the cooperation of the outside surface of the widened portion 44 and the inside surface of the upper portion 26C of the dual skirt of part 26. These two functions are however independent.

In the represented example, the closing configuration is a configuration in which the inside portion of the cap 50 bears longitudinally against the upper portion 25B of the peripheral part 25. However, the existence of such longitudinal bearing could be provided at another location, or even not exist, without this being detrimental to the effects of locking and sealing described above.

The height h of the cap 50 is substantially equal to the travel of the reservoir between its stable configuration of maximum pushing-in and its minimum pushing-in configuration such that in the first position the cap is flush with the level of the free edge 12 of the body, and such that in the second position, the cap provides a sufficient hold to be grasped between the fingers of one hand and extracted from the reservoir.

The contact surface for lateral bearing 15 extends from the cam-forming surface 16 to a depth in the reservoir that is greater than the travel of the reservoir between its upper stable position and its maximum pushing-in configuration, so that, at least in the lower portion of the travel of the reservoir, the applicator and the reservoir are linked to each other. The position of the cam-forming surface 16 is not critical. This position determines at what moment in the travel of the reservoir the applicator and the reservoir are linked to each other or at what moment in the travel of the reservoir that linking unlinks. In the configuration of FIG. 1, the application member is in its closing configuration in the reservoir, while the reservoir is in its stable low configuration of withdrawal in the body. The cap is then retracted into the body and therefore offers no hold to the fingers of a user wishing to pull outwardly on it. It can be understood that the same comment would apply if the cap were to project by only a short distance out of the body.

When the user wishes to use the applicator to apply the product contained in the container, she pushes on the cap, so as to make the reservoir descend into its maximum pushing-in configuration, and to enable the spring to raise the reservoir to its minimum pushing-in configuration of FIG. 2. The contact surface for lateral bearing 15 extends downwardly over a distance such that the descent of the reservoir from its configuration of FIG. 1 to its maximum pushing-in configuration is possible without deterioration of the finger 25C.

At the time of the rising movement of the reservoir in the body under the effect of the spring 31, the locking of the finger 25C by the contact surface for lateral bearing 15 is eliminated as soon as the head clears the cam-forming surface 16 upwardly. However, the finger remains in position brought near to the axis Z-Z until the application member 40 has been extracted from the reservoir. Until that time, the sealing between the flared surface of the widened portion of the shaft 41 and of the flared inside surface of the upper portion of the dual skirt of the part 26 is preserved merely by the contact and the natural adherence that exists between the surfaces providing that sealing.

The fact that the locking can take place by withdrawal of the finger inside the body has the advantage that the reservoir can remain completely inside the body in its stable configuration of minimum withdrawal. It has been seen that, in the example represented, part 25 provides obturation of the lateral space between the reservoir and the body. This obturation is advantageously provided, in the minimum pushing-in configuration of the reservoir of FIG. 2 (or of FIG. 3), at the location of the free edge 12 of the body, that is to say that the widest part of part 25 is then advantageously at the same level as that free edge. It is to be understood that the level at which is situated the cam-forming surface 16 may be freely chosen by the designer of the container, but preferably, that level is located rather towards the maximum pushing-in position than towards the minimum pushing-in position, and for example the cam-forming surface is situated so as to cooperate with the head of the finger at a distance at most equal to one third of the range of movement of the reservoir inside the body from the low resting configuration.

In this configuration of FIG. 2 in which the reservoir 20 is in its minimum pushing-in configuration, the application member 40 is still engaged by friction in the reservoir. Since the cap 50 projects out from the body 10 by a distance enabling the grasping of the cap by the fingers of a user, the extraction of the application member out from the reservoir may be carried out merely by pulling on that cap. That pulling on the application member only induces moderate pulling on the reservoir, and the friction forces between the reservoir and the body may be sufficient to retain the reservoir in the body while the application member frees itself from the reservoir merely by spreading of the widened portion 44 in relation to part 26.

On the extraction of the application member 40, the convergent surface 47 pushes the finger 25C away. And if by any chance the finger moves close to the axis Z-Z when the application member is taken out from the reservoir, it is then the flared bottom portion 45 that repositions the finger in the right position at the time at which the applicator is inserted again into the reservoir.

When it is provided for the peripheral part 25 to come flush with the free edge 12 of the body 10 in the minimum pushing-in configuration (that is to say the stable high configuration of withdrawal), the distance by which the cap 50 projects out from the body is substantially its height h (see FIG. 2). However, it may be provided for the peripheral part not to rise as far as the level of the free edge of the body without the operation described above being substantially modified (see FIG. 4).

Progressively as the pulling on the cap continues, the application member 40 separates from and spreads longitudinally in relation to the reservoir 20. In a first phase, the lower portion of the dual skirt of the part 26 is slightly acted upon elastically due to the diameter of the shaft being advantageously chosen at a value slightly greater than the diameter of the cross section delimited by the free edge of that lower portion when it is not urged towards the wall of the reservoir. Slight scraping of the product that may have become attached to the shaft thus occurs. In a second phase, the lower portion is elastically acted upon by the applicator 42. Since the latter in practice has a cross section greater than that of the shaft, it can be understood that the free edge of the lower portion of the dual skirt provides scraping (or wiping) of the applicator to detach therefrom the excess of product which has been attached thereto. The user may then apply the product as she pleases, where she wishes.

When the user wishes to load the applicator with product again, she plunges the applicator into the reservoir as is done with a usual container. The reservoir is now held in a high stable position by the pushing of the spring and does not move significantly in relation to the body.

When the user has finished applying product and wishes to bring the container into a resting configuration, she pushes the application member into the reservoir and continues to press on the cap, which results in the reservoir beginning to descend into the body. When the reservoir has descended to the level of the cam-forming surface 16, this forces the head of the finger 25C to move closer to the shaft, which results in the finger engaging towards the shaft, above the convergent portion 47. The application member is then locked onto the reservoir. The assembly of these two parts then descends to attain the maximum pushing-in configuration of the reservoir. When the user releases her pushing force, the spring then brings the reservoir back into its stable low configuration of withdrawal in which the cap of the application member is retracted into the body. The application member is then locked in position in the reservoir while the combination of the flared surfaces of the widened portion 44 and of the upper portion of the dual skirt of the part 26 ensures good sealing.

In such a configuration, the locking function is dissociated from the sealing function and these functions are activated by very moderate forces, independently of the longitudinal position of the reservoir in the body, without any part of the reservoir having to come out of the body, longitudinally or laterally in any of the positions of the reservoir. Furthermore, the wiping effect provided by the lower portion of the dual skirt is obtained even though the lower portion extends over a short longitudinal distance. The inside part 26 has a simple form and is easy to manufacture. Similarly, the peripheral part has a simple form and is easy to manufacture. As regards the geometry of the widened portion of the shaft, this is also simple. The number of simple parts is only just three, i.e. the peripheral part 25, the associated finger 25C that is mounted to it, and the inside part 26.

Figure 4:
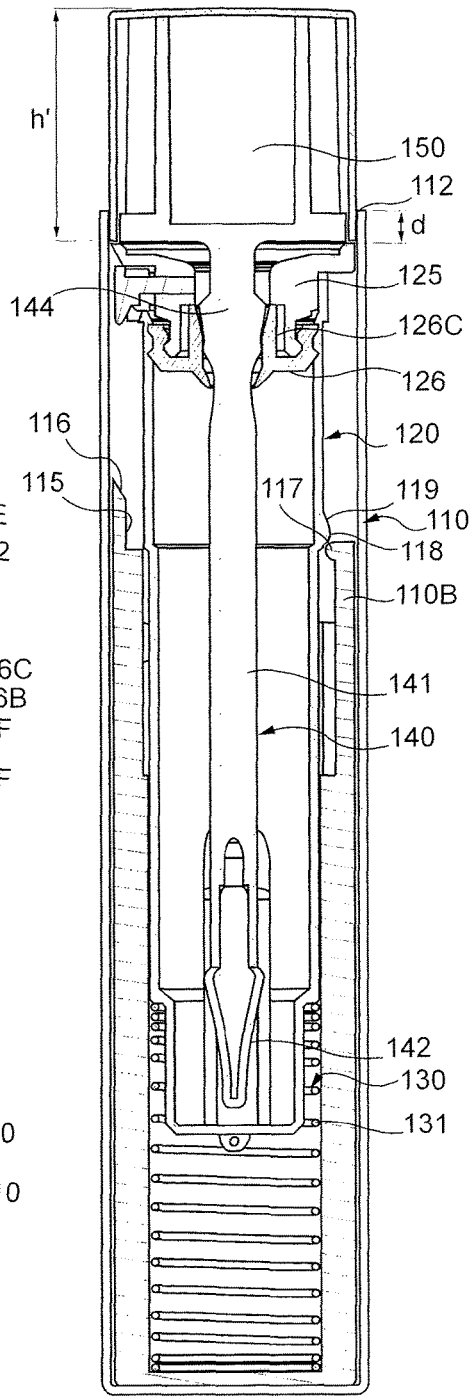
FIG. 4 is an axial cross section view of another container in accordance with the invention, in a second embodiment.

FIG. 4 represents a variant embodiment of a container in accordance with the invention. The reference numerals of the illustrated container, which is denoted 101 overall, are analogous to those of FIGS. 1 to 3 and are designated by reference numerals that are derived from the reference numerals appearing in FIGS. 1 to 3 increased by 100.

The container 101 thus comprises, like the container 1, a body 110, a reservoir 120, an elastically compressible device with two stable positions of withdrawal 130, an application member 140 and a cap 150.

The cap 150 differs slightly from the cap 50 by the geometry of the inside structure, in particular as regards the fact that is by the peripheral part that the inside part comes to bear against the top surface of part 125, without this affecting the operation described above. Moreover, the space situated between the outside surface of the upper portion 126C of the dual skirt of the part 126 and the inside surface of part 125 is greater than in the container 1, which results in enabling greater lateral deformation of that upper portion while facilitating the mounting of the inside part 126 on the peripheral part 125.

In contrast to the case of FIGS. 1 to 3, the reservoir 120 of the container 101 does not rise until the periphery of part 125 is flush with the free edge 112 of the body, but remains below that edge by a distance denoted d. Therefore, when the reservoir is in its minimum pushing-in configuration, the cap does not come fully out from the body, but it is sufficiently raised in relation to the body to enable it to be gripped.

Furthermore, the reservoir and the body have surfaces facing each other that are formed so as to provide retention of the reservoir in the upper position in the body. More specifically, the cage 110B comprised by the body 110 comprises, in at least one zone, here a top zone situated approximately at the location of the contact surface for lateral bearing 115 under the cam-forming surface 116, but being circumferentially offset from it (here to the right in FIG. 4), a projection 117 towards the shaft, whereas the outside surface of the reservoir comprises a projection 118 configured to come just above the projection 117 when the reservoir is in its minimum pushing-in configuration. At least one of these projections, here projection 118, is joined to an inclined surface 119 forming a contact surface for the other projection at the time of a relative rising movement of the reservoir in relation to the body. Thus, when the reservoir passes from the low stable position to the high stable position, the projection 117 slides over the inclined surface which provides a braking effect. The raising of the reservoir under the thrust of the spring is slowed in this way. Other forms of construction may also be appropriate. When the reservoir has attained its high stable position, the projection 118 clears the bump formed by the other projection. This thus provides the effect of a point of increased resistance. This point of increased resistance effect is also experienced on closing the container, when the user presses on the cap 150 to retract it into the body.

The projection 117 is located above a zone in which guide members may be provided to ensure proper guiding of the reservoir in the body without the risk of rotation.

The added-on parts are obtained here by molding of plastic materials, for example a thermoplastics material (polyamide, PVC or low-density polyethylene, in particular) or a high-rigidity elastomer material as regards the peripheral part and an elastomer material for the inside added-on part. As a variant they could form only a single part formed by mono- or bi-injection molding.

Figure 5:
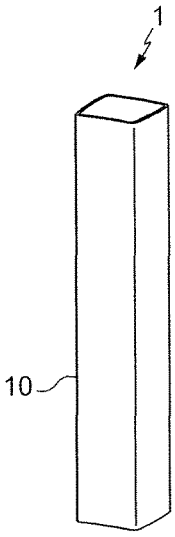
FIG. 5 is a perspective view of the container of FIGS. 1 to 3, in the retracted configuration.
Figure 6:
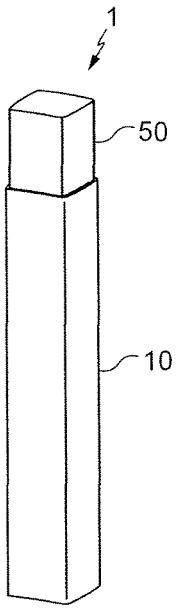
FIG. 6 is a perspective view in the extension configuration.

FIGS. 5 and 6 represent the container 1 in perspective in the retracted configuration of FIG. 1, or in the extension configuration of FIG. 2, respectively. It will be understood that the cross section of the cap is square with the edges slightly bowed. Since the movement of the application member may be engaged by mere translation in the reservoir, it is in fact possible to give the body any desired cross section (polygonal, oval, or the shape of a clover leaf, etc.). It is possible to give the reservoir a similar form (for example slightly smaller than that of the body) or on the contrary a different form, for example a circular cross section, so leaving a space, laterally between the inside surface of the body and the outside surface of the reservoir, which has a maximum width facing the sides of the body, which enables guide members to be accommodated, or part of the elastically compressible device having two stable positions of withdrawal.

Figure 7:
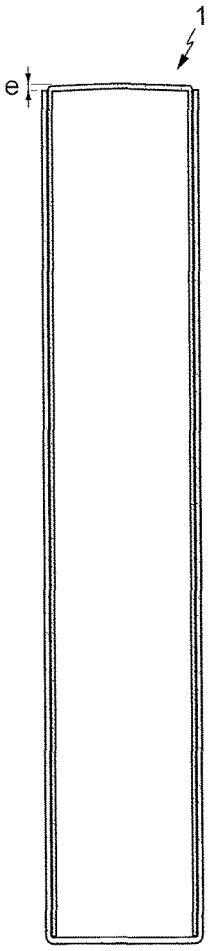
FIG. 7 is a view in elevation of the container in the retracted configuration.

FIG. 7 illustrates that the fact of stating that the cap is retracted into the body does not imply that any part of the cap does not protrude from the volume of the body. In fact, what is important is for the cap to give, outside (to the fingers of a user or to an object that may come into contact with the container, for example in a bag), an insufficient hold to extract the application member from the body, or to push on the cap until the reservoir is made to pass into its maximum pushing-in configuration. In the example represented here, the face of the cap that is accessible at the outside is domed, giving rise to projecting slightly by a distance e.

Figure 8:
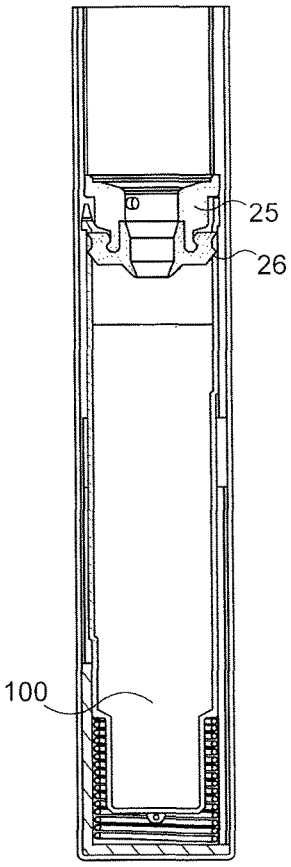
FIG. 8 is a cross section view of the sub-assembly constituted by the body and the reservoir.

Examination of FIG. 8 enables it to be understood that, on account of the small longitudinal bulk of the assembly of parts 25 and 26, the reservoir can be filled with product 100 up to a level close to its free edge.

Lastly, as mentioned earlier, FIGS. 9 and 10, showing perspective views, enable the constitution of the cage 10B, the spring 31, the follower finger 33, and the reservoir 20 to be better understood. It is in particular easier to observe that the cage 10B comprises three uprights positioned here at three of its four corners, with the middle upright, upright 10E that has no upright situated opposite, comprising the track 34, and the upright 10F being extended by the height-increasing portion that terminates with the inclined surface 16 and the contact surface for lateral bearing 15.

The invention is not limited to forms of construction that have been described. It applies generally to any dispenser of cosmetic product in which the liquid or pasty product is applied using an applicator.

The invention claimed is:

1. A container for a pasty or liquid cosmetic product, comprising:

an elongated body, extending in a longitudinal direction, provided with a bottom zone and a free edge;

a reservoir configured to contain the product, the reservoir being movable in translation within the body between a position of maximum pushing-in and a position of minimum pushing-in, the position of minimum pushing-in being a high working position;

the reservoir comprising a bottom and a free edge longitudinally remote from the bottom;

an elastically compressible device comprising a spring interposed between the body and the reservoir;

the elastically compressible device providing two stable axial configurations of withdrawal of the reservoir in relation to a configuration of maximum axial retraction demarcating a position of maximum pushing-in of the reservoir;

the two stable axial configurations comprising:

a maximum extension configuration of the reservoir demarcating the high working position of the reservoir; and a stable retracted configuration demarcating a low resting position of the reservoir, the low resting position being intermediate between the position of maximum pushing-in and the high working position;

movement of the reservoir between the two stable axial configurations being made by retraction of the reservoir into the configuration of maximum axial retraction against the axial spring;

a cap;

an application member comprising a shaft joined to the cap;

an applicator terminating the shaft and configured to be loaded with an amount of the product when the applicator is plunged into the reservoir in a closing configuration in relation to the reservoir as the shaft traverses the edge of the reservoir;

the cap being configured, in the closing configuration, to be retracted at least approximately within the body and, when the reservoir is in the high working position, to project at least partly out from the body by a distance to enable a user to extract the application member out from the reservoir and from the body by means of the user grasping the cap and axially pulling the cap;

complementary members distributed on the shaft of the application member and on the reservoir proximate the free edge of the reservoir to axially link the shaft to the reservoir while ensuring sealing obturation of the reservoir at the free edge of the reservoir when the reservoir is in the maximum pushing-in configuration;

the complementary members comprising:

a peripheral part comprising:

an upper portion capping the edge of the reservoir while extending laterally to an inside surface of the body; and a lower portion sealingly engaged in the reservoir proximate the free edge of the reservoir;

an inside part comprised of a material more flexible than a material of the peripheral part, the inside part being fastened to the peripheral part, the inside part comprising an inside skirt comprising an upper portion having an inside surface flared toward an outside of the reservoir;

a finger extending in the peripheral part for transverse movement of the finger between a position closer to the longitudinal direction and a position farther from the longitudinal direction, the finger comprising a head situated transversely outside the reservoir, but always inside the body;

a cam-forming surface provided on the inside surface of the body, configured to push the head towards the longitudinal direction during a descending movement of the reservoir into the body; and a widened portion provided on the shaft at a location such that, when the application member is in the closing configuration in the reservoir, the widened portion is engaged by friction in the upper portion of the inside skirt and, in relation to the longitudinal direction, is at a lower level than a level of the finger.

2. A container according to claim 1, wherein:

the cam-forming surface is configured to cooperate with the head of the finger over a longitudinal distance at most equal to one third of a range of movement of the reservoir within the body starting from the low resting configuration.

3. A container according to claim 1, wherein:

the flared surface of the upper portion of the inside skirt of the inside part is connected to a formation in relief, or a hollow, configured to cooperate with a hollow, or a formation in relief, formed on the widened portion of the shaft.

4. A container according to claim 1, wherein:

the inside skirt comprises a lower portion convergent towards the bottom of the reservoir and towards the longitudinal direction;

the shaft comprises a constricted zone situated longitudinally at a level such that, when the application member is in the closing configuration in the reservoir, a free edge of the lower portion of the inside skirt of the inside part is situated around the constricted zone.

5. A container according to claim 4, wherein:

the lower portion of the inside skirt of the inside part extends, in the longitudinal direction, over a distance at most equal to half a distance over which extends the upper portion of the inside skirt.

6. A container according to claim 4, wherein:

the lower portion of the inside skirt of the inside part has a lessening thickness along a direction toward the bottom of the reservoir.

7. A container according to claim 1, wherein:

the widened portion of the shaft of the application member comprises a convergent portion extending from an upper edge of a flared surface of the widened portion towards the shaft, so as to force spreading of the finger in relation to the shaft during a longitudinal movement of removing the application member from the reservoir.

8. A container according to claim 1, wherein:

the peripheral part and the inside part are made of moldable plastic materials.

9. A container according to claim 1, wherein:

the body comprises an outside part and an inside part in which is provided the cam-forming surface.

10. A container according to claim 1, wherein:

the inside surface of the body and the outside surface of the reservoir comprise complementary members constituting a point of increased resistance inducing resistance to a descent of the reservoir into the body from its high working position.

* * * * *